US008387806B2

(12) United States Patent
Schneider

(10) Patent No.: US 8,387,806 B2
(45) **Date of Patent: *Mar. 5, 2013**

(54) PRODUCT DISPLAY SHELF WITH COMPLIANT MEMBER

(75) Inventor: Raymond Schneider, Port Washington, NY (US)

(73) Assignee: Display Technologies, College Point, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/487,331

(22) Filed: Jun. 4, 2012

(65) Prior Publication Data

US 2012/0234783 A1 Sep. 20, 2012

Related U.S. Application Data

(63) Continuation of application No. 13/157,500, filed on Jun. 10, 2011, now Pat. No. 8,205,759, which is a continuation of application No. 12/106,648, filed on Apr. 21, 2008, now Pat. No. 7,975,858.

(60) Provisional application No. 60/925,406, filed on Apr. 20, 2007.

(51) Int. Cl.
*A47B 73/00* (2006.01)

(52) U.S. Cl. ..... 211/75

(58) Field of Classification Search ..... 211/74, 211/75, 87.01, 90.01, 183; 248/683, 205.5, 248/206.3, 467, 309.3; 40/597; 206/829
See application file for complete search history.

(56) References Cited

U.S. PATENT DOCUMENTS

| | | | |
|---|---|---|---|
| 104,787 | A | 6/1870 | Snow |
| 350,523 | A | 10/1886 | Bodley |
| 1,299,575 | A | 4/1919 | Holmes |
| 1,483,035 | A | 2/1924 | Edward |
| 2,491,652 | A | 12/1949 | Feerick |
| 2,695,105 | A | 11/1954 | Mitchell |
| 3,391,891 | A | 7/1968 | Garden |
| 3,429,542 | A | 2/1969 | Fagan |
| 4,286,717 | A | 9/1981 | Liesinger |
| 4,560,072 | A | 12/1985 | Burrell |
| 4,828,211 | A | 5/1989 | McConnell et al. |
| 4,899,895 | A | 2/1990 | Espasandin et al. |
| 5,096,272 | A | 3/1992 | Belokin et al. |
| 5,613,614 | A | 3/1997 | Richardson |
| 6,510,953 | B2 | 1/2003 | Daniels |
| 7,004,334 | B2 | 2/2006 | Walsh et al. |
| 7,306,106 | B2 | 12/2007 | Robertson |
| 7,556,159 | B2 | 7/2009 | Robertson |
| 7,975,858 | B2 | 7/2011 | Schneider |
| 2006/0102570 | A1 | 5/2006 | Robertson |
| 2006/0102572 | A1 | 5/2006 | Robertson |
| 2008/0041803 | A1 | 2/2008 | Robertson |
| 2009/0084739 | A1 | 4/2009 | Shock et al. |

*Primary Examiner* — Jennifer E. Novosad
(74) *Attorney, Agent, or Firm* — Carter, DeLuca, Farrell & Schmidt, LLP

(57) ABSTRACT

A product display shelf comprising a bottom surface, a rear surface and at least one compliant member is disclosed. The bottom surface is configured to support at least one product thereon. The rear surface extends upwardly from the bottom surface. The at least one compliant member is disposed in mechanical cooperation with the rear surface and is configured to substantially prevent the product supported by the bottom surface from movement relative to the bottom surface upon movement of the product display shelf.

20 Claims, 6 Drawing Sheets

PRODUCT DISPLAY SHELF WITH COMPLIANT MEMBER

CROSS-REFERENCE TO RELATED APPLICATION

The present application is a Continuation of, claims the benefits of and priority to U.S. patent application Ser. No. 13/157,500 filed on Jun. 10, 2011, which is a Continuation of, claims the benefits of and priority to U.S. Pat. No. 7,975,858 filed on Apr. 21, 2008. The present application also claims the benefits of and priority to U.S. Provisional Application Ser. No. 60/925,406, filed on Apr. 20, 2007. The entire contents of each of which being incorporated herein by reference.

BACKGROUND

The present disclosure relates generally to product displays used on a door. More particularly, the present disclosure relates to a product display shelf for use on a door and includes a member for stabilizing products on the product display shelf.

Shelves that are attachable to an interior of a door (e.g., a glass refrigerator or freezer door) are known in the art. An example of such a shelf is one that can be attached to the door using suction cups. In use, when shelves are attached to the interior of a door, the opening and closing of the door (e.g., by a customer) may cause products displayed on the shelf to move with respect to the shelf. For example, products may move back-and-forth, side-to-side, and may even fall off the shelf.

SUMMARY

The present disclosure relates to a product display shelf comprising a bottom surface, a rear surface and at least one compliant member. The bottom surface is configured to support at least one product thereon. The rear surface extends upwardly from the bottom surface. The at least one compliant member is disposed in mechanical cooperation with the rear surface and is configured to substantially prevent the product supported by the bottom surface from movement relative to the bottom surface upon movement of the product display shelf.

The present disclosure also relates to a method of displaying products. The method includes the step of providing a product display shelf including a bottom surface, a rear surface and at least one compliant member. The rear surface extends upwardly from the bottom surface. The at least one compliant member is disposed in mechanical cooperation with the rear surface and is configured to substantially prevent a product from movement relative to the bottom surface upon movement of the product display shelf. The method also includes the steps of removably securing the product display shelf to a vertical surface and positioning a product on the bottom surface such that a proximal portion of the product is in contact with the vertical surface while at least a distal portion of the product is in contact with the compliant member.

BRIEF DESCRIPTION OF FIGURES

Various embodiments of the presently disclosed product display shelf with compliant member are disclosed herein with reference to the drawings, wherein.

DETAILED DESCRIPTION

Figure 1:
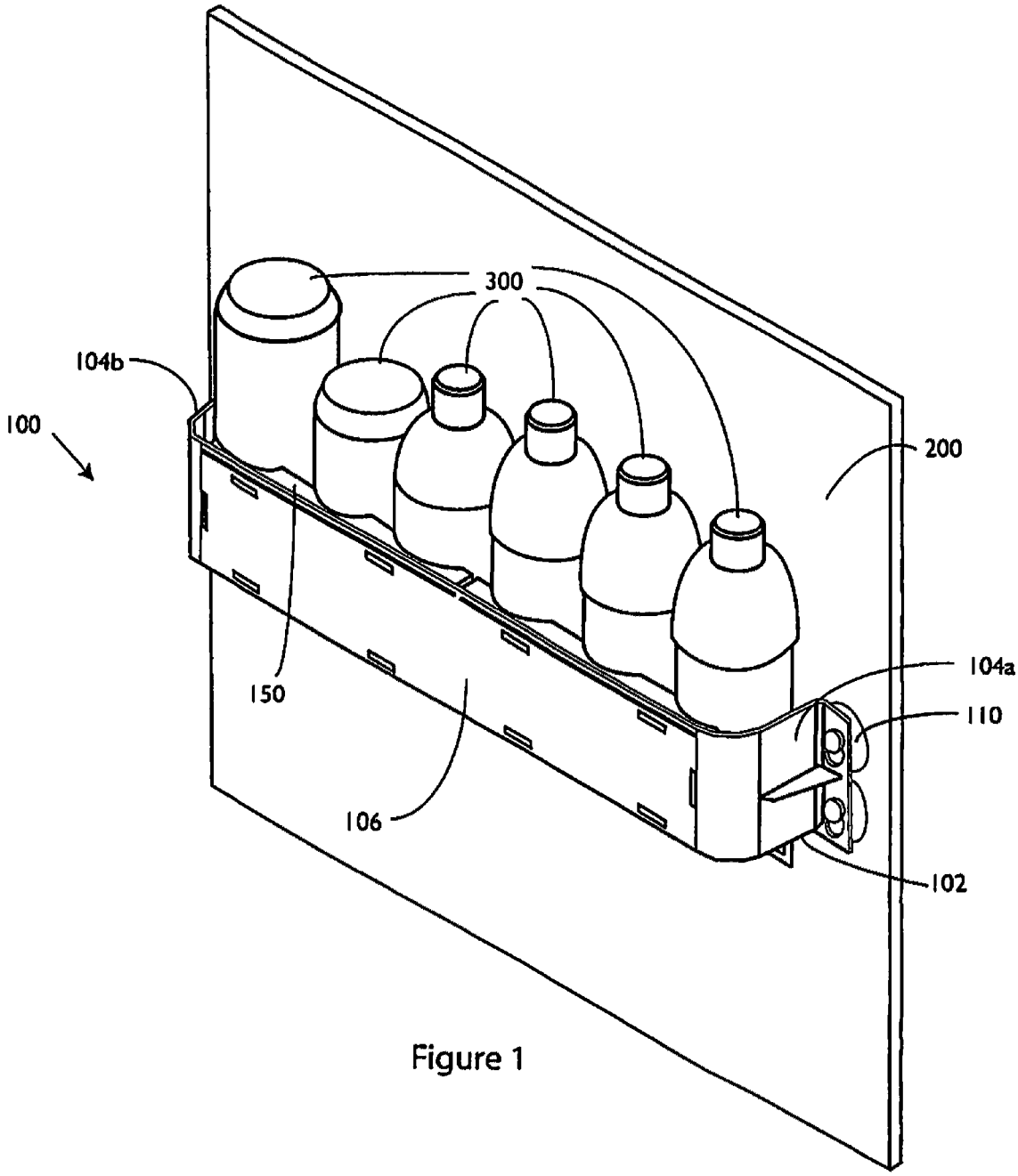
FIG. 1 is a perspective view of a product display shelf having a compliant member, in accordance with an embodiment of the present disclosure.
Figure 2:
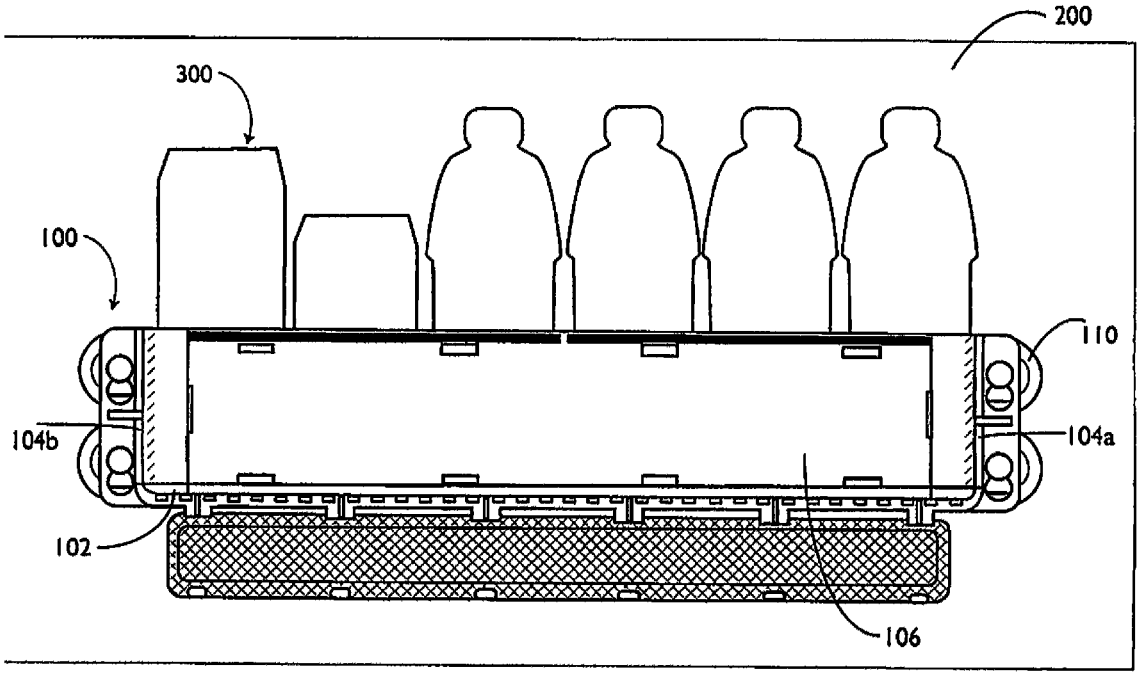
FIG. 2 is a front view of the product display shelf of FIG. 1.
Figure 3:
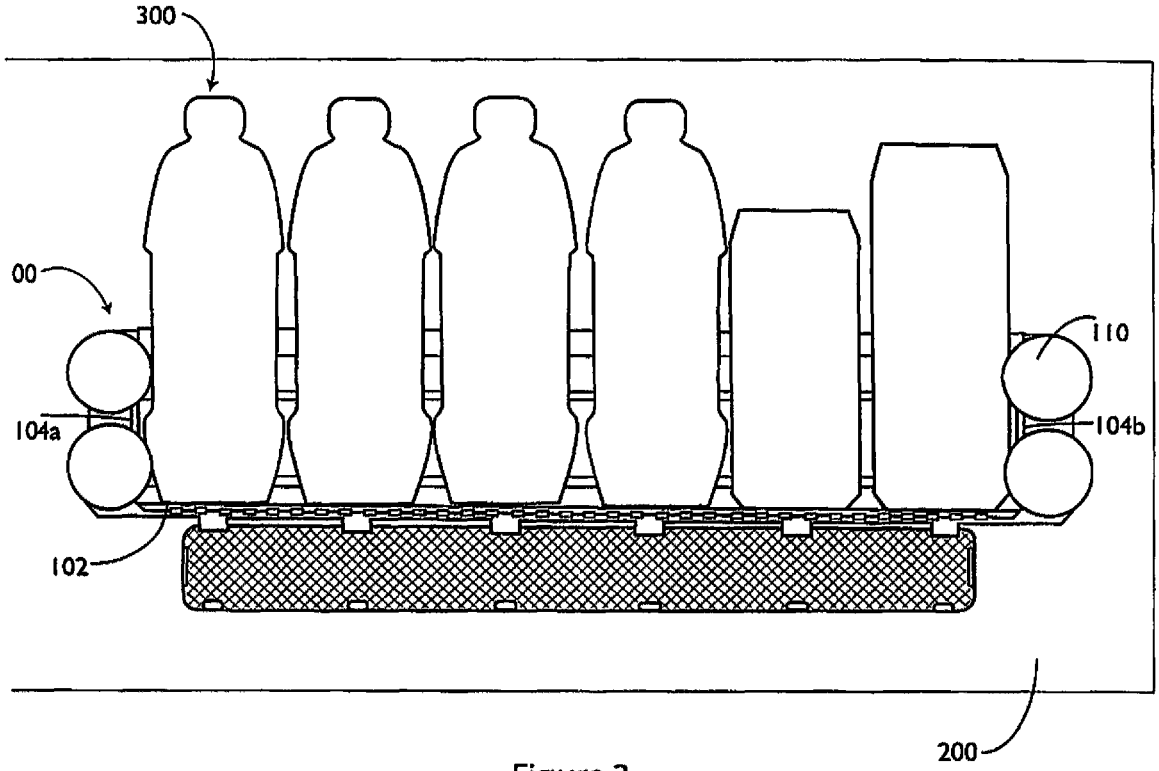
FIG. 3 is a rear view of the product display shelf of FIGS. 1 and 2.
Figure 4:
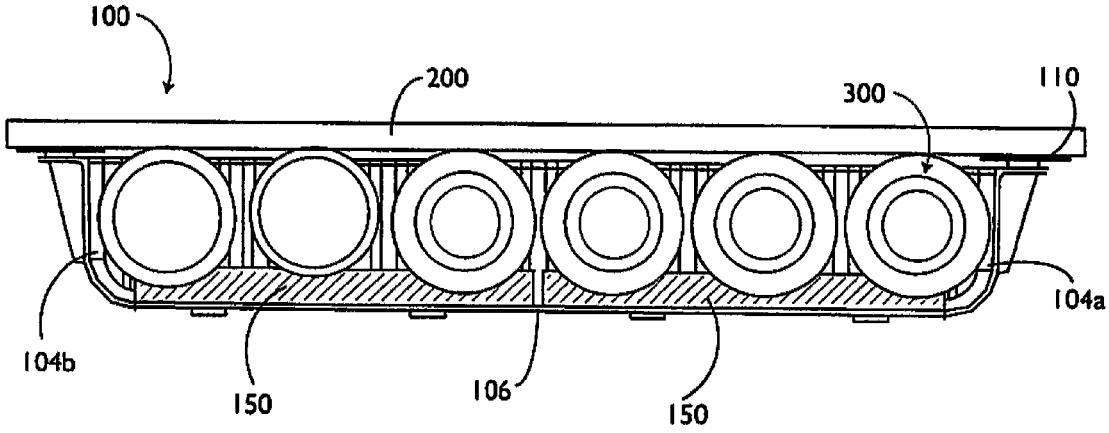
FIG. 4 is a top view of the product display shelf of FIGS. 1-3.

Embodiments of the presently disclosed product display shelf are described in detail with reference to the drawings wherein like numerals designate identical or corresponding elements in each of the several views. As is common in the art, the term "proximal" refers to that part or component closer to the user, e.g., customer, while the term "distal" refers to that part or component farther away from the user.

In combination with the accompanying FIGS. 1-6, a product display shelf 100 of the present disclosure is described herein. In the illustrated embodiments, shelf 100 is configured to be removably attached to a vertical surface 200 (e.g., a glass refrigerator or freezer door) by a securing structure 110 (e.g., at least one suction cup). Shelf 100 includes a bottom surface 102, two sides 104*a*, 104*b*, a rear surface 106, and a substantially open front (proximal portion), which faces vertical surface 200. The front of shelf 100 is substantially open to allow consumers to view products 300 disposed on shelf 100 (e.g., through a glass refrigerator or freezer door).

Shelf 100 also includes at least one flexible compliant member 150 in mechanical cooperation therewith. Compliant member 150 is configured to be secured (e.g., removably secured) to a portion of shelf 100 (e.g., rear surface 106) and to come into contact with a product 300 on shelf 100. It is envisioned that compliant member 150 substantially prevents products 300 that are on shelf 100 from movement relative to bottom surface 102 upon movement of product display shelf 10 (e.g., when door 200 is opened and/or closed by a customer). That is, with particular reference to FIG. 4, compliant member 150 (or more than one compliant member 150) at least partially fills the otherwise empty space between an individual product 300 and rear surface 106 of shelf 100. With continued reference to FIG. 4, compliant member 150 also allows securely positioning products 300 of different sizes (e.g., different transverse cross-sections) on shelf 100 such that the products 100 are substantially free from movement relative to bottom surface 102 upon movement of shelf 100 (e.g., upon the opening of refrigerator or freezer door).

Due at least in part to its flexibility, compliant member 150 substantially conforms to the shape of a portion of product 300 and puts pressure on product 300 in a proximal direction (i.e., towards vertical surface 200). Thus, products 300 are snuggly held between compliant member 150 and door 200. Accordingly, the use of compliant member 150 with shelf 100 helps prevent products 300 on shelf 100 from undergoing substantial movement when vertical surface 200 is moved (e.g., door is opened and/or closed).

Figure 5:
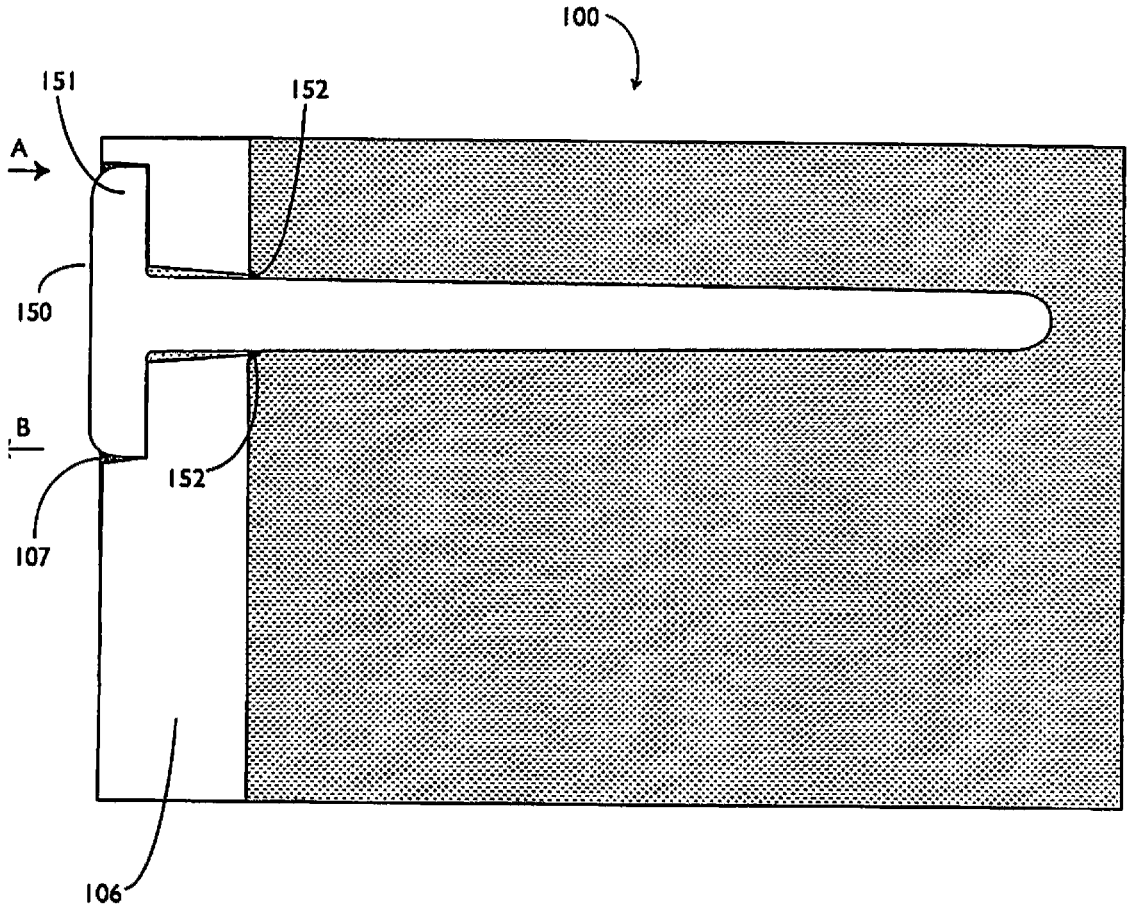
FIG. 5 is a transverse cross-sectional view of an embodiment of a compliant member inserted through a portion of the product display shelf of FIGS. 1-4.
Figure 6:
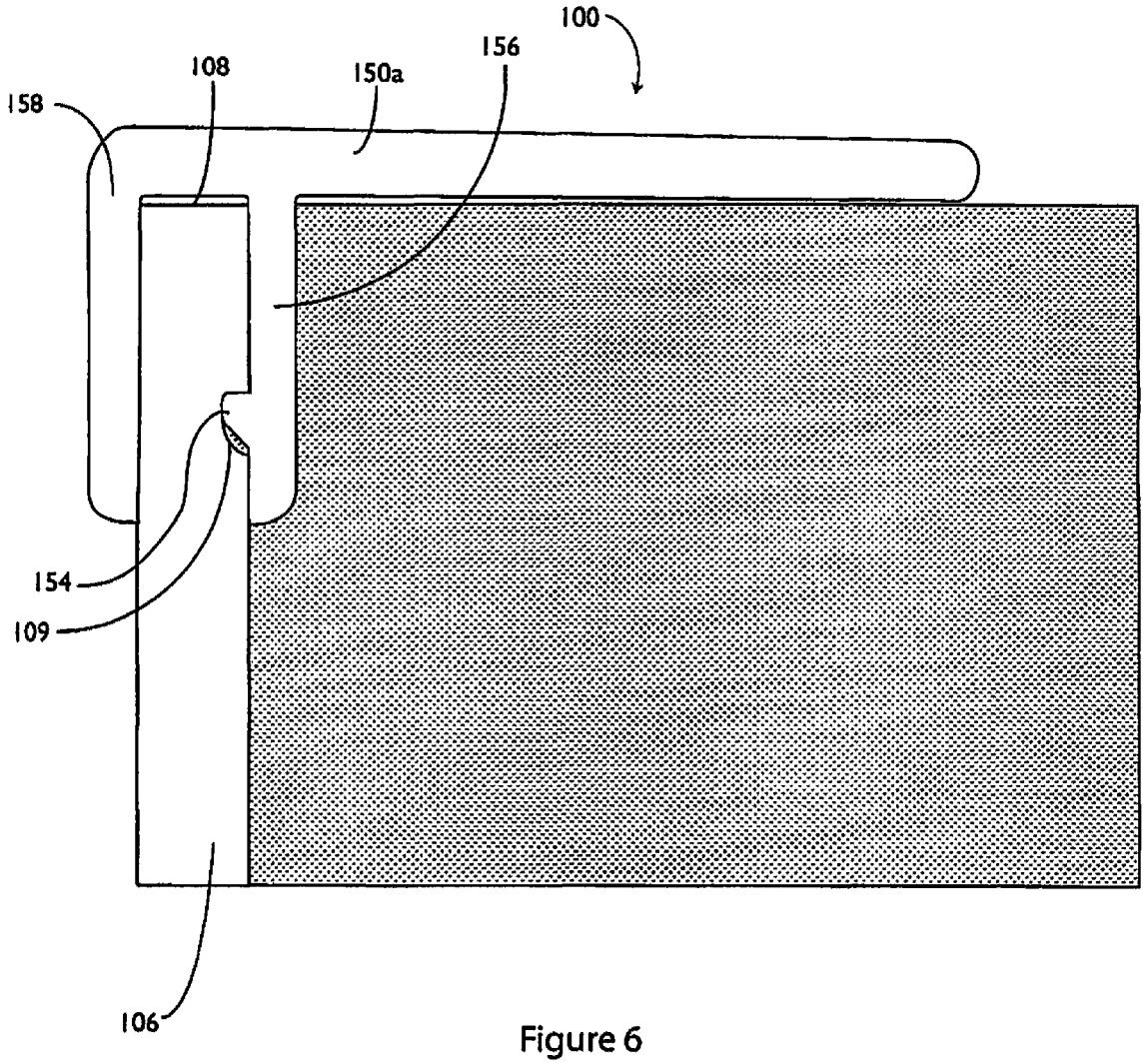
FIG. 6 is a transverse cross-sectional view of another embodiment of a compliant member placed over a portion of the product display shelf of FIGS. 1-4.

With reference to FIGS. 5 and 6, compliant member 150 may be installed on shelf 100 in a variety of ways. For example, in FIG. 5 (illustrating a transverse cross-sectional view of compliant member 150 through rear portion 106 of shelf 100), compliant member 150 is installed by inserting compliant member 150 through an opening 107 (e.g., a longitudinal slot) in rear portion 106 of shelf 100 in a proximal direction (arrow "A"). Further, compliant member 150 is illustrated having protrusions 152 which help prevent unintentional ejection of compliant member 150 in a distal direction (arrow "B"). As illustrated in FIG. 5, a distal portion 151 of compliant member 150 is larger than at least a portion of opening 107, such that compliant member 150 is prevented from being inserted entirely through rear portion 106. Additionally, FIG. 5 illustrates opening 107 in rear portion 106 being configured to allow at least a portion of distal portion 151 of compliant member 150 to be at least partially recessed within rear portion 106.

In FIG. 6, another embodiment of a compliant member is illustrated and is referred to as reference numeral 150*a*. Compliant member 150*a* is configured to be placed over an edge 108 of rear portion 106 of shelf 100. Here, compliant member 150*a* includes a first leg 156 and a second leg 158. As shown, first leg 156 contacts a proximal side of rear portion 106 and second leg 158 contacts a distal side of rear portion 106. As can be appreciated, compliant member 150*a* of this embodiment can be used in conjunction with a conventional, non-modified product display shelf.

Additionally, first leg 156 of compliant member 150*a* is shown including a lip 154 for mechanically engaging a notch 109 on the proximal side of rear portion 106 of shelf 100 to help secure compliant member 150 thereon. It is also envisioned that lip 154 may alternatively or additionally be included on the distal side of rear portion 106 to engage a notch on the distal side (not shown) of rear portion 106.

As can be appreciated, the configurations of compliant members 150, 150*a* allow for removal and interchangeability. For instance, if compliant member 150, 150*a* becomes damaged or soiled, a user can remove old compliant member 150, 150*a* and insert a new compliant member 150, 150*a* in its place.

It is envisioned that at least a portion of compliant member 150, 150*a* (e.g., the proximally extending elongated portion) may be made of a flexible polyvinyl chloride (PVC) material, a plurality of bristles, another suitable material, and/or any combinations thereof. Additionally, the different portions of compliant member 150, 150*a* may be made of different materials from one another, or alternatively, compliant member 150 150*a* may be monolithically formed.

In embodiments of the present disclosure, compliant member 150, 150*a*, may include a rigid portion or may be entirely rigid (or substantially rigid). That is, compliant member 150, 150*a* may be configured for use with a particular shelf 100 (e.g., based on a width of its bottom surface 102) and a particular product 300. For instance, it is envisioned that a product-contacting portion of compliant member 150, 150*a* may include a series of concavities, where each concavity is configured for securing a specific product (e.g., a beverage can, a beverage bottle, a one liter bottle, a two liter bottle, etc.) having any regular or irregular shape with respect to product display shelf 100.

While several embodiments of the disclosure have been shown in the figures, it is not intended that the disclosure be limited thereto, as it is intended that the disclosure be as broad in scope as the art will allow and that the specification be read likewise. Therefore, the above description should not be construed as limiting, but merely as exemplifications of various embodiments. Those skilled in the art will envision other modifications within the scope and spirit of this disclosure.

The invention claimed is:

1. A shelf, comprising:

a bottom surface for at least partially supporting at least one item thereon;

a rear surface disposed in mechanical cooperation with the bottom surface;

at least one side wall disposed in mechanical cooperation with the rear surface, a portion of the side wall configured to engage an external surface to removably secure the shelf thereto; and at least one member disposed in mechanical cooperation with at least one of the rear surface and the at least one side wall, the member configured to substantially prevent the item supported by the bottom surface from movement relative to the bottom surface upon movement of the external surface, the member extending in the same general direction as the rear surface along a majority of an entire length of the member, a distal portion of the member being in substantial contact with the rear surface along a majority of the entire length of the member.

2. The shelf of claim 1, wherein an item-contacting surface of the member is configured to deflect into a substantially semi-circular shape.

3. The shelf of claim 1, wherein the member is configured to simultaneously extend at least two different distances from the rear surface.

4. The shelf of claim 1, wherein the member is at least partially made from a flexible polyvinyl chloride material.

5. The shelf of claim 1, wherein the member is insertable through an opening in the rear surface.

6. The shelf of claim 5, wherein the member includes at least one protrusion extending therefrom, the protrusion being configured to help maintain the position of the member with respect to the rear surface.

7. The product display shelf of claim 1, wherein the member is positionable over an upper edge of the rear surface.

8. The shelf of claim 7, wherein the rear surface includes a notch for releasably accepting a lip of the member.

9. The shelf of claim 1, further comprising a securing structure disposed in mechanical cooperation with a proximal portion of the side wall.

10. The shelf of claim 1, wherein the at least one side wall includes a first side wall and a second side wall, a distal portion of each of the side walls being engaged with the rear surface, a proximal portion of each side wall configured to engage the external surface to removably secure the shelf thereto.

11. The shelf of claim 1, wherein the side wall is substantially perpendicular to the member along a majority of the entire length of the member.

12. The shelf of claim 1, wherein the member includes a plurality of bristles.

13. The shelf of claim 1, wherein the member includes a rigid portion.

14. The shelf of claim 1, wherein an item-contacting portion of the member includes a plurality of concavities, wherein each concavity is configured for engaging a specific type of item.

15. The shelf of claim 1, wherein a proximal portion of the member is free from contact with the rear surface and free from contact with the side wall along at least a majority of the length of the member.

16. The shelf of claim 1, wherein the member and the rear surface are substantially parallel with each other along a majority of the entire length of the member.

17. The shelf of claim 1, wherein the at least one side wall extends proximally from the rear surface, and wherein a proximal portion of the side wall is configured to engage the external surface to removably secure the shelf thereto.

18. A shelf, comprising:

a bottom surface for at least partially supporting at least one item thereon;

a rear surface disposed in mechanical cooperation with the bottom surface;

at least one side wall disposed in mechanical cooperation with the rear surface, a portion of the side wall configured to engage an external surface to removably secure the shelf thereto; and at least one member disposed in mechanical cooperation with at least one of the rear surface and the at least one side wall, the member configured to substantially prevent the item supported by the bottom surface from movement relative to the bottom surface upon movement of the external surface, the member extending in the same general direction as the rear surface along a majority of an entire length of the member, wherein an item-contacting surface of the member is configured to deflect into a substantially semi-circular shape.

19. A shelf, comprising:

a bottom surface for at least partially supporting at least one item thereon;

a rear surface disposed in mechanical cooperation with the bottom surface;

at least one side wall disposed in mechanical cooperation with the rear surface, a portion of the side wall configured to engage an external surface to removably secure the shelf thereto; and at least one member disposed in mechanical cooperation with at least one of the rear surface and the at least one side wall, the member configured to substantially prevent the item supported by the bottom surface from movement relative to the bottom surface upon movement of the external surface, the member extending in the same general direction as the rear surface along a majority of an entire length of the member, wherein the member is configured to simultaneously extend at least two different distances from the rear surface.

20. A shelf, comprising:

a bottom surface for at least partially supporting at least one item thereon;

a rear surface disposed in mechanical cooperation with the bottom surface;

at least one side wall disposed in mechanical cooperation with the rear surface, a portion of the side wall configured to engage an external surface to removably secure the shelf thereto; and at least one member positioned over an upper edge of the rear surface, the member configured to substantially prevent the item supported by the bottom surface from movement relative to the bottom surface upon movement of the external surface, the member extending in the same general direction as the rear surface along a majority of an entire length of the member.

* * * * *